US011721503B2

(12) United States Patent
Kawada

(10) Patent No.: US 11,721,503 B2
(45) Date of Patent: Aug. 8, 2023

(54) VACUUM INTERRUPTER

(71) Applicant: Mitsubishi Electric Corporation, Tokyo (JP)

(72) Inventor: Masashi Kawada, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 184 days.

(21) Appl. No.: 17/428,026

(22) PCT Filed: Apr. 16, 2020

(86) PCT No.: PCT/JP2020/016673
§ 371 (c)(1),
(2) Date: Aug. 3, 2021

(87) PCT Pub. No.: WO2020/218137
PCT Pub. Date: Oct. 29, 2020

(65) Prior Publication Data

US 2022/0108856 A1 Apr. 7, 2022

(30) Foreign Application Priority Data

Apr. 23, 2019 (JP) ..... 2019-081465

(51) Int. Cl.
*H01H 33/664* (2006.01)

(52) U.S. Cl.
CPC ..... *H01H 33/6642* (2013.01)

(58) Field of Classification Search
CPC ..... H01H 33/6642; H01H 33/6643; H01H 33/664; H01H 33/6641; H01H 33/6644; H01H 33/6645; H01H 33/185
(Continued)

(56) References Cited

U.S. PATENT DOCUMENTS 4,293,748 A * 10/1981 Sakuma ..... H01H 33/6643 218/128
6,048,216 A * 4/2000 Komuro ..... H01H 1/0203 439/130

(Continued)

FOREIGN PATENT DOCUMENTS

JP 2001052576 A 2/2001

OTHER PUBLICATIONS

International Search Report (PCT/ISA/210) with translation and Written Opinion (PCT/ISA/237) dated Jul. 14, 2020, by the Japan Patent Office as the International Searching Authority for International Application No. PCT/JP2020/016673. (8 pages).

*Primary Examiner* — William A Bolton
(74) *Attorney, Agent, or Firm* — Buchanan Ingersoll & Rooney PC

(57) ABSTRACT

A vacuum interrupter includes: an insulation cylinder; a fixed-side flange; a movable-side flange; a fixed-side electrode rod fixed to the fixed-side flange at one end and having a fixed-side electrode fitting shaft on a fixed-side end surface at another end; a movable-side electrode rod connected to the movable-side flange via a bellows at one end and having a movable-side electrode fitting shaft on a movable-side end surface at another end; a fixed-side windmill-shaped electrode fixed to the fixed-side electrode fitting shaft; and a movable-side windmill-shaped electrode fixed to the movable-side electrode fitting shaft. A fixed-side support member having a fixed-side spacer portion and a fixed-side planar portion is provided between the fixed-side end surface and the fixed-side windmill-shaped electrode, and a movable-side support member having a movable-side spacer portion and a movable-side planar portion is provided between the movable-side end surface and the movable-side windmill-shaped electrode.

15 Claims, 17 Drawing Sheets

(58) Field of Classification Search
USPC ..... 218/128, 123, 127
See application file for complete search history.

(56) References Cited

U.S. PATENT DOCUMENTS

| | | | | |
|---|---|---|---|---|
| 6,479,778 | B1 | 11/2002 | Kimura et al. | |
| 8,653,397 | B2 * | 2/2014 | Yang | H01H 33/664 218/143 |
| 8,779,317 | B2 * | 7/2014 | Kim | H01H 33/664 218/123 |
| 9,330,869 | B2 * | 5/2016 | Harada | H01H 33/185 |
| 10,128,070 | B2 * | 11/2018 | Zhou | H01H 33/664 |
| 2002/0144977 | A1 * | 10/2002 | Kikuchi | H01H 1/0203 218/123 |
| 2004/0000536 | A1 * | 1/2004 | Schellekens | H01H 33/664 218/123 |
| 2014/0048514 | A1 * | 2/2014 | Balasubramanian | H01H 33/6643 218/123 |
| 2016/0111239 | A1 * | 4/2016 | Sollazzi | H01H 50/14 335/151 |
| 2019/0035578 | A1 * | 1/2019 | Ochi | H01H 33/6643 |

* cited by examiner

VACUUM INTERRUPTER

TECHNICAL FIELD

The present disclosure relates to a vacuum interrupter.

BACKGROUND ART

In a conventional vacuum interrupter, metal flanges are fixed by vacuum brazing to metallization layers formed at both ends of an insulation cylinder made of alumina ceramic or the like, so as to keep the inside of the container airtight in a high vacuum state, whereby an insulation container as a vacuum container is formed. At the metal flanges fixed to both ends of the insulation cylinder, a fixed-side electrode rod and a movable-side electrode rod are respectively attached coaxially so as to be opposed to each other. A fixed-side electrode and a movable-side electrode are respectively fixed to the opposed surfaces of the electrode rods.

In addition, a bellows is provided between the movable-side electrode rod and the metal flange so that the movable-side electrode is movable on the axis of the insulation container while keeping the airtight state. An umbrella-shaped bellows cover provided for preventing contamination of the bellows by arc occurring at the time of current interruption is fixed to the movable-side electrode rod. The bellows itself is, on the electrode side, joined by brazing to the bellows cover or to the bellows cover and the movable-side electrode rod, and is, on the side opposite to the electrode, attached to the movable-side flange. In addition, an arc shield is provided inside the insulation container so as to surround the electrodes opposed to each other, and thus prevents the inner circumferential surface of the insulation container from being contaminated by arc occurring at the time of current interruption. A guide is attached to an end of the movable-side electrode rod, and the guide has a bearing function so that the movable-side electrode rod smoothly moves on the axis during the opening/closing process.

As a kind of the fixed-side electrode and the movable-side electrode, a windmill-shaped electrode is known. The windmill-shaped electrode has a plurality of grooves formed in a swirl shape from the center part toward the peripheral part and thus a plurality of arc portions are formed adjacently to the grooves. In a case where the vacuum interrupter is closed and current is applied, the arc portions of the fixed-side electrode and the movable-side electrode are in contact with each other, and in a case where current is interrupted, the fixed-side electrode and the movable-side electrode are opened, whereby arc occurs at any point on the arc portions of the fixed-side electrode and the movable-side electrode.

At the time of the interruption, the arc rotationally moves at a high speed on the arc portions, whereby local heat concentration due to the arc is prevented until a current zero point is reached. Thus, damage of the windmill-shaped electrodes can be reduced and interruption performance of the vacuum interrupter can be improved. In the vacuum interrupter in which the windmill-shaped electrodes are incorporated, the windmill-shaped electrodes are fitted to electrode fitting shafts provided to the electrode rods, and are fixed by brazing or the like. An arc drive force increases with increase in the distance between the electrode fitting shaft of the electrode rod and an arc occurrence part on the electrode surface.

On the back side of the windmill-shaped electrode, a reinforcing plate made from stainless steel or the like which is a material having a higher electric resistance than the windmill-shaped electrode and the electrode rod is fixed, thus preventing the electrode from being deformed by a load at the time of electrode closing, and inhibiting contamination inside the insulation container due to arc occurring at the time of current interruption. In addition, a spacer made from a material having a higher electric resistance than the windmill-shaped electrode and the electrode rod like the reinforcing plate is provided between the reinforcing plate and the electrode rod. Such a configuration is disclosed in, for example, Patent Document 1.

CITATION LIST

Patent Document

Patent Document 1: Japanese Laid-Open Patent Publication No. 2001-52576

SUMMARY OF THE INVENTION

Problems to be Solved by the Invention

In Patent Document 1, the reinforcing plate and the spacer made from a material having a higher electric resistance than the windmill-shaped electrode and the electrode rod are incorporated between the windmill-shaped electrode and the electrode rod, whereby the windmill-shaped electrode is prevented from being deformed by a load at the time of electrode closing and thus the windmill-shaped electrode can be reinforced. In addition, scattering of metal spatter occurring at the time of current interruption is prevented, whereby contamination inside the insulation container can be inhibited. However, there is a problem that leakage current flows to the reinforcing plate and the spacer. If leakage current flows to the reinforcing plate and the spacer, the current density of current flowing through the windmill-shaped electrode is reduced, so that the magnetic flux density of a generated magnetic field is also reduced. That is, the arc drive force proportional to the magnetic flux density is also reduced and the rotation speed of arc is slowed down. Thus, damage of the windmill-shaped electrode due to local heat concentration by arc becomes less likely to be reduced, leading to reduction in the interruption performance. In addition, since the reinforcing plate and the spacer are incorporated, a current path is formed at a part other than the electrode fitting shaft, so that a current path leading to the arc occurrence part is shortened and the arc drive force is reduced. If the diameter of the windmill-shaped electrode is increased, the distance between the electrode fitting shaft and the arc occurrence part of the windmill-shaped electrode can be ensured, whereby the arc drive force can be increased. However, this method leads to size increase in the vacuum interrupter, resulting in a problem that the weight and the cost of the vacuum interrupter are increased.

The present disclosure has been made to solve the above problems, and an object of the present disclosure is to obtain a vacuum interrupter that has a function of reinforcing the windmill-shaped electrode and a function of preventing scattering of metal spatter occurring at the time of current interruption, and that inhibits leakage current flowing to a part other than the windmill-shaped electrode and the electrode rod.

Solution to the Problems

A vacuum interrupter according to the present disclosure includes: an insulation cylinder; a fixed-side flange sealing one end of the insulation cylinder; a movable-side flange sealing another end of the insulation cylinder; a fixed-side electrode rod which is fixed to the fixed-side flange at one end, and has a fixed-side electrode fitting shaft protruding from a fixed-side end surface at another end and having a smaller outer diameter than the fixed-side end surface; a movable-side electrode rod which is, at one end, connected to the movable-side flange via a bellows on an inner side of the insulation cylinder, and has a movable-side electrode fitting shaft protruding from a movable-side end surface at another end and having a smaller outer diameter than the movable-side end surface, the movable-side electrode rod being slidable in an axial direction of the insulation cylinder; a fixed-side windmill-shaped electrode fixed to the fixed-side electrode fitting shaft and having a plurality of grooves formed in a swirl shape from a center part toward a peripheral part; and a movable-side windmill-shaped electrode fixed to the movable-side electrode fitting shaft so as to be opposed to the fixed-side windmill-shaped electrode, and having a plurality of grooves formed in a swirl shape from a center part toward a peripheral part. A fixed-side support member is held between the fixed-side end surface and the fixed-side windmill-shaped electrode, the fixed-side support member including a fixed-side spacer portion which has a cylindrical shape and surrounds the fixed-side electrode fitting shaft while being distant from the fixed-side electrode fitting shaft, and a fixed-side planar portion which has a disk shape and which spreads outward from an outer circumferential side surface of the fixed-side spacer portion and is opposed to the fixed-side windmill-shaped electrode. A movable-side support member is held between the movable-side end surface and the movable-side windmill-shaped electrode, the movable-side support member including a movable-side spacer portion which has a cylindrical shape and surrounds the movable-side electrode fitting shaft while being distant from the movable-side electrode fitting shaft, and a movable-side planar portion which has a disk shape and which spreads outward from an outer circumferential side surface of the movable-side spacer portion and is opposed to the movable-side windmill-shaped electrode.

Effect of the Invention

The vacuum interrupter according to the present disclosure has a function of reinforcing the windmill-shaped electrode and a function of preventing scattering of metal spatter occurring at the time of current interruption, and can inhibit leakage current flowing to a part other than the windmill-shaped electrode and the electrode rod.

DESCRIPTION OF EMBODIMENTS

Figure 1:
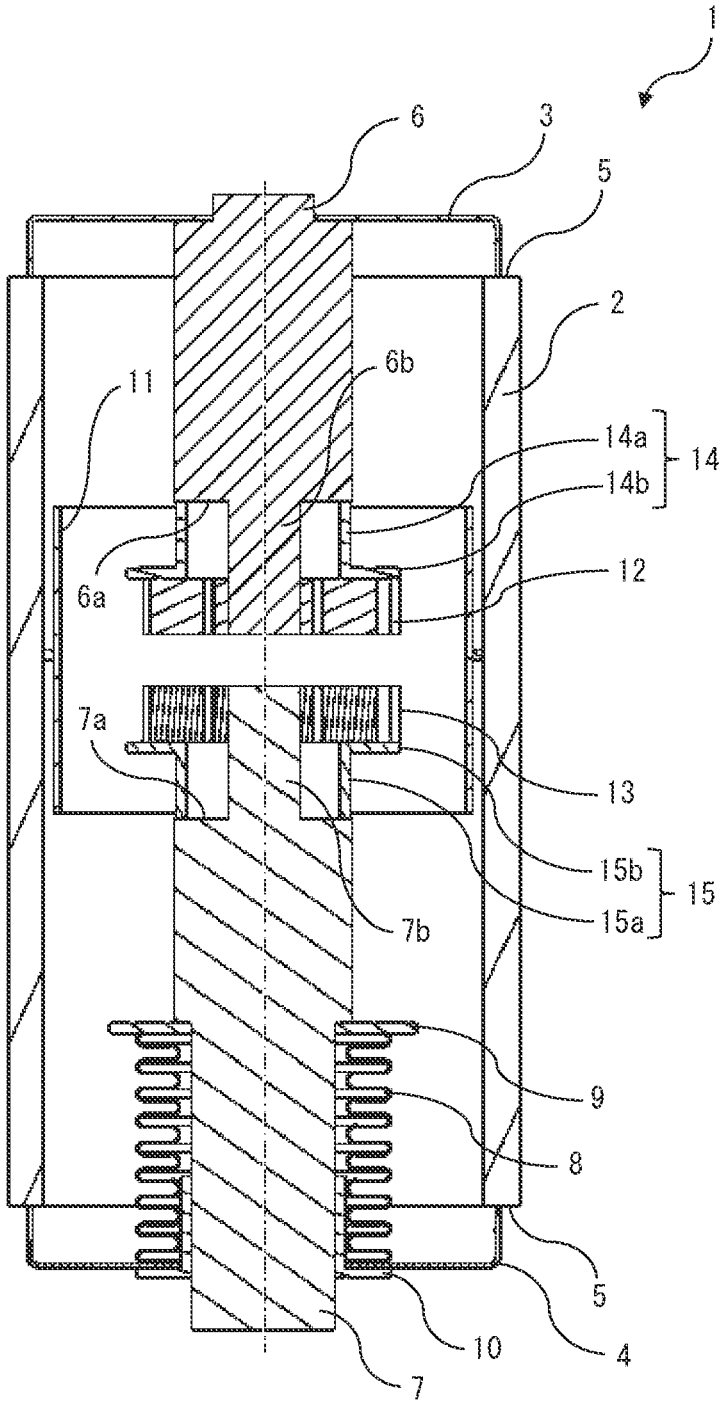
FIG. 1 is a sectional view showing a schematic structure of a vacuum interrupter according to embodiment 1.

Hereinafter, vacuum interrupters according to embodiments of the present disclosure will be described with reference to the drawings. In the drawings, the same or corresponding members and parts are denoted by the same reference characters, to give description.

Embodiment 1

Figure 2:
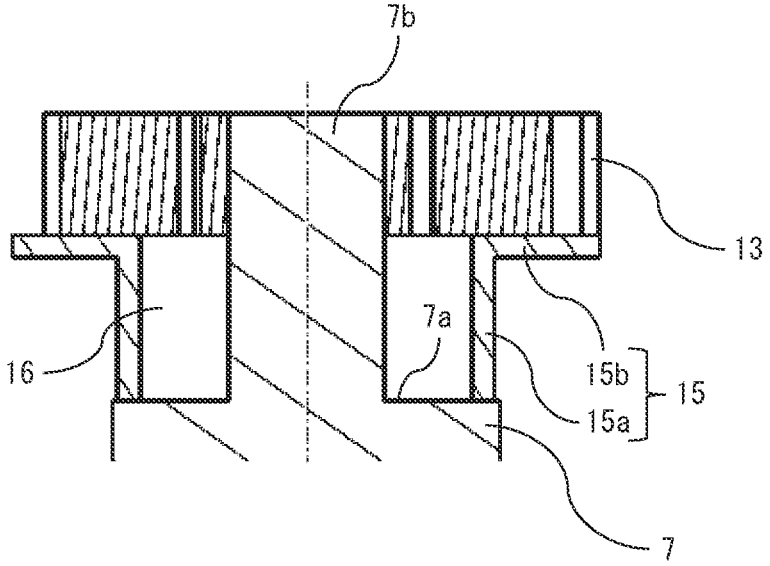
FIG. 2 is a sectional view showing a schematic structure around a windmill-shaped electrode of the vacuum interrupter according to embodiment 1.

FIG. 1 is a sectional view showing a schematic structure of a vacuum interrupter 1, and FIG. 2 is a sectional view showing a schematic structure around a movable-side windmill-shaped electrode 13 of the vacuum interrupter 1. The vacuum interrupter 1 is configured such that a fixed-side windmill-shaped electrode 12 and the movable-side windmill-shaped electrode 13 which are opened at the time of current interruption are provided inside an airtight container formed by an insulation cylinder 2, a fixed-side flange 3, and a movable-side flange 4.

The structure of the vacuum interrupter 1 will be described. The vacuum interrupter 1 includes the insulation cylinder 2 having a cylindrical shape and made of an insulating material such as alumina ceramic, the fixed-side flange 3 sealing one end of the insulation cylinder 2 and made of metal such as stainless steel, and the movable-side flange 4 sealing the other end of the insulation cylinder 2 and made of metal such as stainless steel. The inside of the vacuum interrupter 1 is kept airtight in a high vacuum state. The fixed-side flange 3 and the movable-side flange 4 are fixed by vacuum brazing to metallization layers 5 formed at both ends of the insulation cylinder 2.

The vacuum interrupter 1 includes a fixed-side electrode rod 6 and a movable-side electrode rod 7. The fixed-side electrode rod 6 is, at one end, fixed to the fixed-side flange 3 on the inner side of the insulation cylinder 2, and has a fixed-side electrode fitting shaft 6*b* protruding from a fixed-side end surface 6*a* at another end and having a smaller outer diameter than the fixed-side end surface 6*a*. The movable-side electrode rod 7 is, at one end, connected to the movable-side flange 4 via a bellows 8 on the inner side of the insulation cylinder 2, and has a movable-side electrode fitting shaft 7*b* protruding from a movable-side end surface 7*a* at another end and having a smaller outer diameter than the movable-side end surface 7*a*. The movable-side electrode rod 7 is slidable in the axial direction of the insulation cylinder 2. One end of the bellows 8 and the movable-side electrode rod 7 are fixed to each other via a bellows cover 9. The bellows cover 9 is provided for preventing the bellows 8 from being contaminated by arc occurring at the time of current interruption, and is made of stainless steel, for example. A guide 10 made of thermoplastic synthetic resin or the like is attached to the movable-side flange 4 after the vacuum interrupter 1 is sealed in a vacuum state. The movable-side electrode rod 7 and the guide 10 are sliding portions, and the guide 10 has a bearing function. For the purpose of preventing the inner circumferential surface of the insulation cylinder 2 from being contaminated by arc occurring between the fixed-side windmill-shaped electrode 12 and the movable-side windmill-shaped electrode 13 at the time of current interruption, an arc shield 11 is provided so as to surround the fixed-side windmill-shaped electrode 12 and the movable-side windmill-shaped electrode 13.

Figure 3:
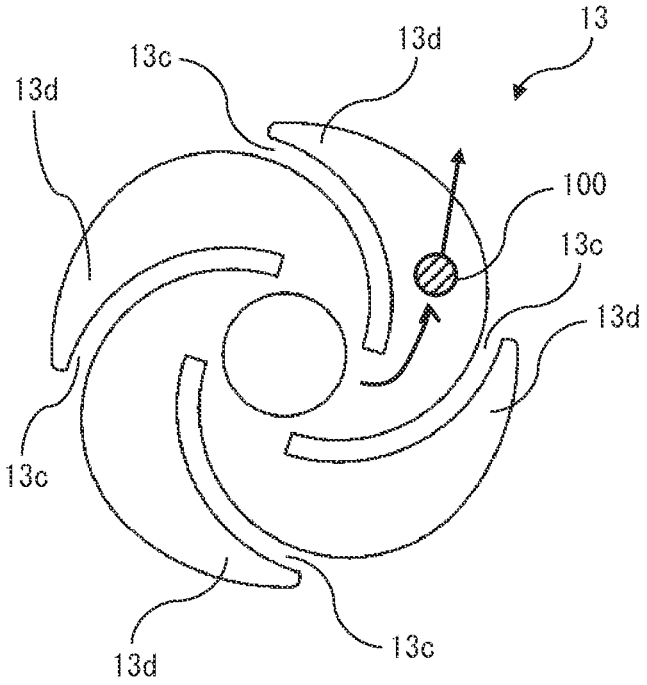
FIG. 3 is a plan view showing the windmill-shaped electrode of the vacuum interrupter according to embodiment 1.

As shown in FIG. 2, the movable-side windmill-shaped electrode 13 is fitted to the movable-side electrode fitting shaft 7*b*, and fixed thereto by brazing or the like. While FIG. 2 shows the schematic structure around the movable-side windmill-shaped electrode 13, the schematic structure around the fixed-side windmill-shaped electrode 12 is also the same structure. Since the movable-side electrode rod 7 to which the movable-side windmill-shaped electrode 13 is fixed is attached to the movable-side flange 4 via the bellows 8, the movable-side windmill-shaped electrode 13 is allowed to contact with and be separated from the fixed-side windmill-shaped electrode 12 on the axis of the insulation cylinder 2 while the airtight state is kept. FIG. 3 is a plan view showing the movable-side windmill-shaped electrode 13 of the vacuum interrupter 1 according to embodiment 1. The movable-side windmill-shaped electrode 13 has a plurality of grooves 13*c* formed in a swirl shape from the center part toward the peripheral part and thus an arc portion 13*d* is formed between two grooves 13*c*. The fixed-side windmill-shaped electrode 12 also has the same structure, and arc portions of the fixed-side windmill-shaped electrode 12 are provided at positions opposed to the arc portion 13*d* so that the respective arc portions come into contact with each other. When the fixed-side windmill-shaped electrode 12 and the movable-side windmill-shaped electrode 13 are opened at the time of current interruption, arc 100 occurs at any point on the arc portions 13*d*. Current $I_X$ applied to the movable-side windmill-shaped electrode 13 flows from the center along the shape of the arc portions 13*d* and then flows to the arc portions of the opposed fixed-side windmill-shaped electrode 12 via the arc 100. At this time, a magnetic flux density $B_X$ (not shown) occurs by the current $I_X$. The arc 100 is subjected to a drive force $F_X$ proportional to the magnetic flux density $B_X$, and thus rotationally moves at high speed counterclockwise on the arc portions 13*d*.

Figure 4A:
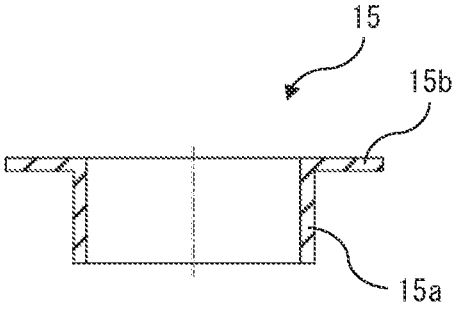
FIG. 4A and FIG. 4B are views showing a schematic structure of a support member of the vacuum interrupter according to embodiment 1.
Figure 4B:
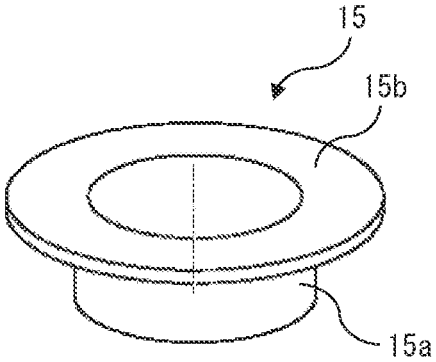

As shown in FIG. 2, a movable-side support member 15 is held between the movable-side end surface 7*a* and the movable-side windmill-shaped electrode 13. Similarly, a fixed-side support member 14 is held between the fixed-side end surface 6*a* and the fixed-side windmill-shaped electrode 12. FIG. 4A and FIG. 4B are views showing a schematic structure of the movable-side support member 15 of the vacuum interrupter 1. FIG. 4A is a sectional view and FIG. 4B is a perspective view. The fixed-side support member 14 also has the same structure as the movable-side support member 15. Hereinafter, the fixed-side support member 14 and the movable-side support member 15 have the same shape and the same function in the same embodiment, and therefore description will be give using only one movable-side support member 15. The movable-side support member 15 includes a movable-side spacer portion 15*a* which has a cylindrical shape and surrounds the movable-side electrode fitting shaft 7*b* while being distant from the movable-side electrode fitting shaft 7*b*, and a movable-side planar portion 15*b* which has a disk shape and which spreads outward from an outer circumferential side surface of the movable-side spacer portion 15*a* and is opposed to the movable-side windmill-shaped electrode 13. The movable-side planar portion 15*b* is provided at an end of the movable-side spacer portion 15*a* on the side in contact with the movable-side windmill-shaped electrode 13. A space 16 is formed between the movable-side spacer portion 15*a* and the movable-side electrode fitting shaft 7*b*.

The movable-side support member 15 is made of metal whose electric resistance is higher than those of the movable-side windmill-shaped electrode 13 and the movable-side electrode rod 7. For example, the movable-side support member 15 is made of stainless steel, and manufactured through cutting work from a round bar or a pipe material, press work from a pipe material or a plate material, or the like. Since the sectional area of the movable-side spacer portion 15*a* is small, the electric resistance of the movable-side spacer portion 15*a* is high. In addition, since the contact area between the movable-side spacer portion 15*a* and the movable-side electrode rod 7 is small, the resistance therebetween is high. Thus, leakage current flowing from the movable-side windmill-shaped electrode 13 or the movable-side electrode rod 7 to the movable-side spacer portion 15*a* is inhibited. It is noted that the movable-side support member 15 is not limited to such an integrally formed structure, and may be formed by combining a plurality of parts.

The movable-side support member 15 has a function of reinforcing the movable-side windmill-shaped electrode 13. Specifically, the movable-side support member 15 has a function of preventing the movable-side windmill-shaped electrode 13 from being deformed by a load when the movable-side windmill-shaped electrode 13 and the fixed-side windmill-shaped electrode 12 are closed, and preventing the movable-side windmill-shaped electrode 13 from being deformed by an external pressing force applied to the vacuum interrupter 1 for increasing the contact area and reducing contact resistance between the movable-side windmill-shaped electrode 13 and the fixed-side windmill-shaped electrode 12. In addition, the movable-side planar portion 15*b* has a function of preventing scattering of metal spatter occurring at the time of current interruption.

Since the movable-side spacer portion 15*a* is provided and the movable-side electrode fitting shaft 7*b* is formed with a length equivalent to the movable-side spacer portion 15*a*, the movable-side electrode fitting shaft 7*b* is provided with a sufficient distance so that current flowing from the movable-side electrode rod 7 to the movable-side electrode fitting shaft 7*b* is collected in the movable-side electrode fitting shaft 7*b*.

Since the space 16 is provided, a path of current flowing from a part other than the movable-side electrode fitting shaft 7*b* into the movable-side windmill-shaped electrode 13 is restricted. While interruption is repeated, a phenomenon in which the arc-shaped grooves of the windmill-shaped electrode are gradually filled up due to wear of the electrode surface may occur. Even in this case, owing to provision of the space 16, the grooves are prevented from being closed over the entire surfaces. Thus, reduction in interruption performance is inhibited and the life for short-circuit interruption is also improved.

Fixation of the movable-side support member 15 will be described. The movable-side support member 15 may be held by only contact without being fixed by the movable-side windmill-shaped electrode 13 and the movable-side electrode rod 7 which are contact parts with the movable-side support member 15. Alternatively, the movable-side support member 15 may be fixed only at the contact part between the movable-side support member 15 and the movable-side windmill-shaped electrode 13. The fixation in this case may be performed by brazing with a brazing material put between the movable-side support member 15 and the movable-side windmill-shaped electrode 13, for example. By this fixation, position displacement of the movable-side support member 15 is inhibited. The movable-side support member 15 and the movable-side electrode rod 7 are merely in contact with each other and the resistance therebetween is high. Thus, leakage current flowing therebetween can be inhibited. Accordingly, current flowing through the movable-side windmill-shaped electrode 13 is increased and the arc drive force is increased, whereby interruption performance can be improved.

The movable-side support member 15 may be fixed only at the contact part between the movable-side support member 15 and the movable-side electrode rod 7. The fixation in this case may be performed by brazing with a brazing material put between the movable-side support member 15 and the movable-side electrode rod 7, for example. By this fixation, position displacement of the movable-side support member 15 is inhibited. The movable-side support member 15 and the movable-side windmill-shaped electrode 13 are merely in contact with each other and the resistance therebetween is high. Thus, leakage current flowing therebetween can be inhibited. Accordingly, current flowing through the movable-side windmill-shaped electrode 13 is increased and the arc drive force is increased, whereby interruption performance can be improved.

The movable-side support member 15 may be fixed at the contact part between the movable-side support member 15 and the movable-side windmill-shaped electrode 13 and at the contact part between the movable-side support member 15 and the movable-side electrode rod 7. The fixation in this case may be performed by brazing, for example. By this fixation, position displacement of the movable-side support member 15 is inhibited. Even if an electromagnetic force is applied to the movable-side electrode fitting shaft 7*b* from the outside when short-circuit current flows, since the movable-side support member 15 made of a material having a great strength is fixed at two parts of the movable-side windmill-shaped electrode 13 and the movable-side electrode rod 7, deformation of the movable-side electrode fitting shaft 7*b* which is comparatively thin and has a small strength can be prevented.

Figure 5A:
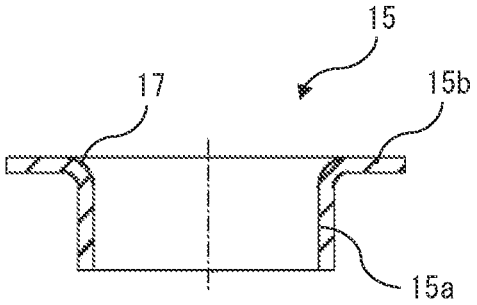
FIG. 5A and FIG. 5B are views showing a schematic structure of another support member of the vacuum interrupter according to embodiment 1.
Figure 5B:
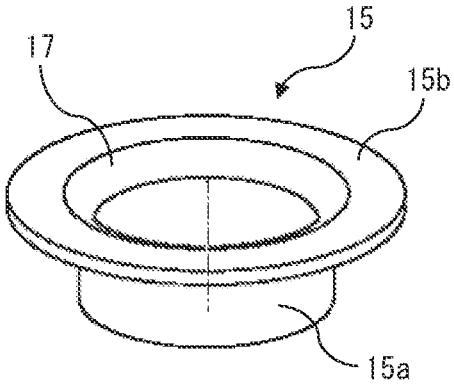
Figure 6A:
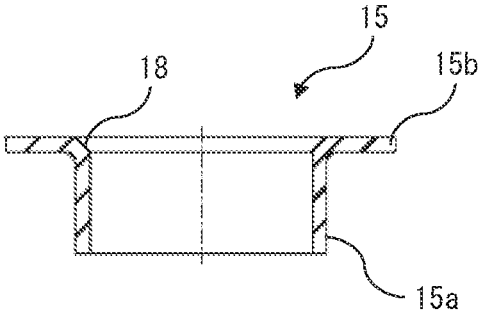
FIG. 6A and FIG. 6B are views showing a schematic structure of another support member of the vacuum interrupter according to embodiment 1.
Figure 6B:
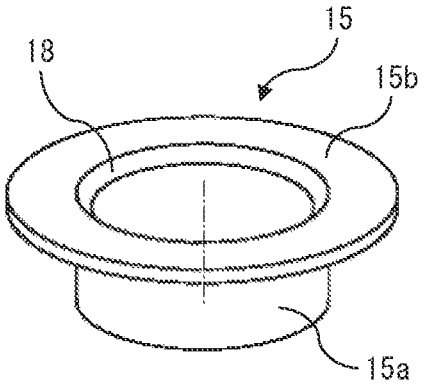

Another structure example of the movable-side support member 15 will be described. FIG. 5A and FIG. 5B are views showing a schematic structure of another movable-side support member 15 of the vacuum interrupter 1 according to embodiment 1. FIG. 5A is a sectional view and FIG. 5B is a perspective view. The fixed-side support member 14 also has the same structure as the movable-side support member 15. The movable-side planar portion 15*b* and the movable-side spacer portion 15*a* are connected via a rounded portion 17. In a case where the movable-side support member 15 is manufactured by cutting work or press work, the rounded portion 17 which is a connection portion between the movable-side planar portion 15*b* and the movable-side spacer portion 15*a* can be easily formed into a rounded shape, and thus workability is improved. In addition, forming the rounded shape can relax stress concentration on the connection portion due to a load from an external pressing force and impact at the time of electrode closing. In order to obtain the above effects, it is desirable that the rounding size of the rounded portion 17 is equal to or greater than the thickness of the movable-side support member 15. FIG. 6A and FIG. 6B are views showing a schematic structure of still another movable-side support member 15 of the vacuum interrupter 1 according to embodiment 1. FIG. 6A is a sectional view and FIG. 6B is a perspective view. The movable-side planar portion 15*b* and the movable-side spacer portion 15*a* of the movable-side support member 15 are connected via a tapered portion 18. Providing the tapered portion 18 exhibits the same effects as in the case of the rounded portion 17.

As described above, the vacuum interrupter 1 has the fixed-side support member 14 between the fixed-side end surface 6*a* and the fixed-side windmill-shaped electrode 12, and the movable-side support member 15 between the movable-side end surface 7*a* and the movable-side windmill-shaped electrode 13. Thus, the vacuum interrupter 1 has a function of reinforcing the fixed-side windmill-shaped electrode 12 and the movable-side windmill-shaped electrode 13, and can inhibit leakage current flowing through parts other than the fixed-side windmill-shaped electrode 12 and the movable-side windmill-shaped electrode 13, and the fixed-side electrode rod 6 and the movable-side electrode rod 7. In addition, the fixed-side support member 14 and the movable-side support member 15 respectively have the fixed-side planar portion 14*b* and the movable-side planar portion 15*b*, thus having a function of preventing scattering of metal spatter occurring at the time of current interruption. In addition, since the leakage current is inhibited, current supplied to the fixed-side windmill-shaped electrode 12 and the movable-side windmill-shaped electrode 13 is increased. Thus, the magnetic flux density of a magnetic field occurring at the time of electrode opening is increased and the arc drive force is increased, whereby the arc rotation speed increases. As a result, the interruption performance can be improved without size increase in the fixed-side windmill-shaped electrode 12 and the movable-side windmill-shaped electrode 13.

Embodiment 2

Figure 7:
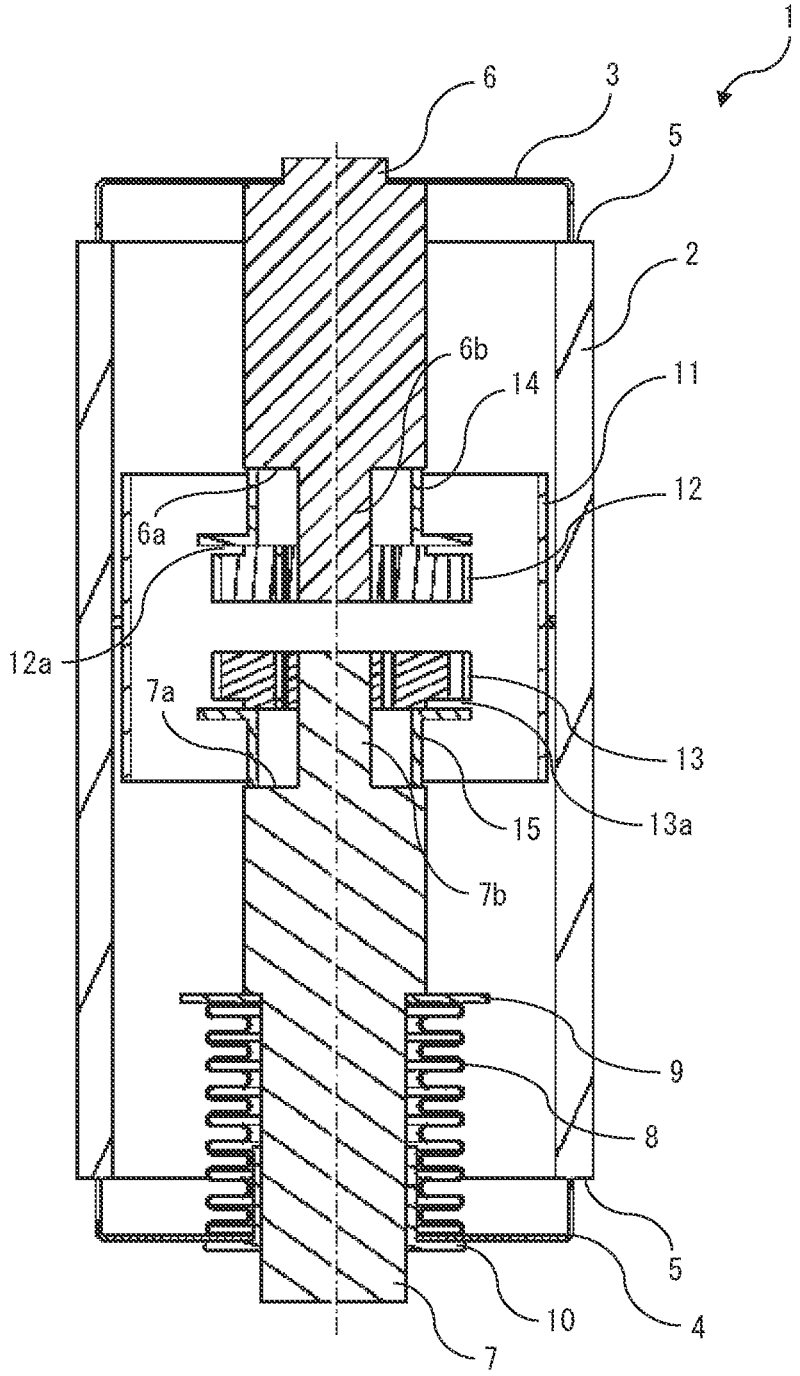
FIG. 7 is a sectional view showing a schematic structure of a vacuum interrupter according to embodiment 2.
Figure 8:
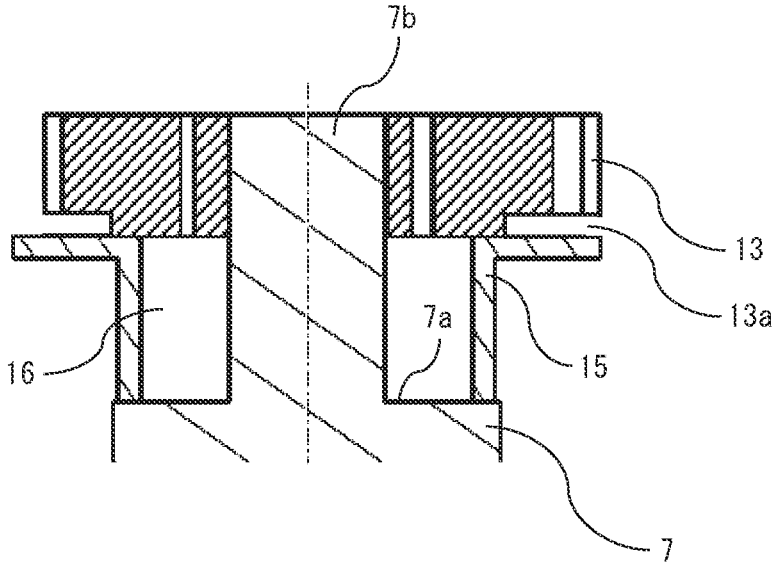
FIG. 8 is a sectional view showing a schematic structure around a windmill-shaped electrode of the vacuum interrupter according to embodiment 2.

A vacuum interrupter 1 according to embodiment 2 will be described. FIG. 7 is a sectional view showing a schematic structure of the vacuum interrupter 1. FIG. 8 is a sectional view showing a schematic structure around the movable-side windmill-shaped electrode 13 of the vacuum interrupter 1. The vacuum interrupter 1 according to embodiment 2 is configured such that cutouts 12*a*, 13*a* are respectively provided in the fixed-side windmill-shaped electrode 12 and the movable-side windmill-shaped electrode 13 of the vacuum interrupter 1 shown in embodiment 1. While FIG. 8 shows the schematic structure around the movable-side windmill-shaped electrode 13, the schematic structure around the fixed-side windmill-shaped electrode 12 is also the same structure.

The cutout 13*a* is provided around the circumference of an end surface of the movable-side windmill-shaped electrode 13 on the side in contact with the movable-side planar portion 15*b*. The cutout 12*a* is provided in the fixed-side windmill-shaped electrode 12. The cutouts 12*a*, 13*a* are formed through cutting work after the fixed-side windmill-shaped electrode 12 and the movable-side windmill-shaped electrode 13 are manufactured, for example.

As described above, the vacuum interrupter 1 has the cutouts 12*a*, 13*a*, so that the contact areas between the fixed-side planar portion 14*b* and the fixed-side windmill-shaped electrode 12 and between the movable-side planar portion 15*b* and the movable-side windmill-shaped electrode 13, are reduced. Thus, the resistances therebetween are increased, whereby leakage current flowing from the fixed-side windmill-shaped electrode 12 and the movable-side windmill-shaped electrode 13 to the fixed-side planar portion 14*b* and the movable-side planar portion 15*b* is inhibited. In addition, since the leakage current is inhibited, current supplied to the fixed-side windmill-shaped electrode 12 and the movable-side windmill-shaped electrode 13 is increased. Thus, the magnetic flux density of a magnetic field occurring at the time of electrode opening is increased and the arc drive force is increased, whereby the arc rotation speed increases. As a result, the interruption performance can be improved without size increase in the fixed-side windmill-shaped electrode 12 and the movable-side windmill-shaped electrode 13.

Embodiment 3

Figure 9:
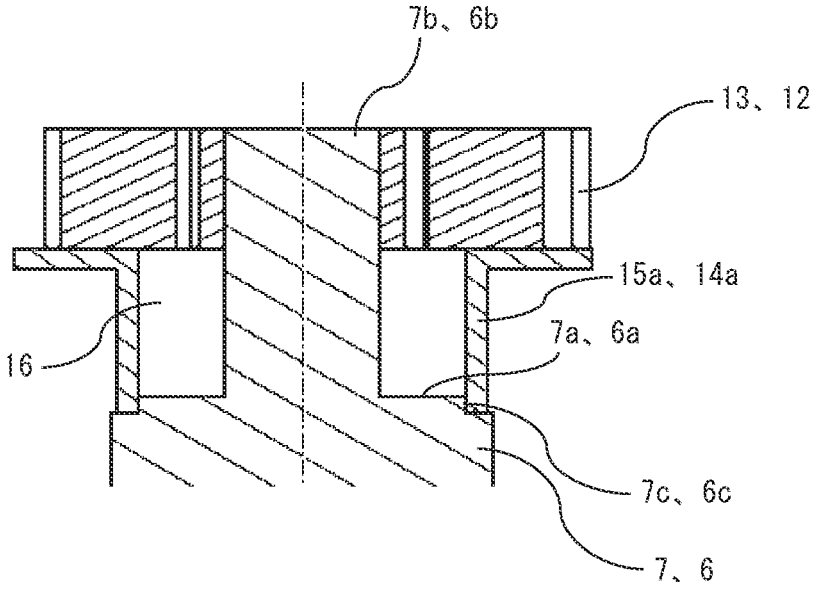
FIG. 9 is a sectional view showing a schematic structure around a windmill-shaped electrode of a vacuum interrupter according to embodiment 3.

A vacuum interrupter 1 according to embodiment 3 will be described. FIG. 9 is a sectional view showing a schematic structure around the movable-side windmill-shaped electrode 13 of the vacuum interrupter 1. The vacuum interrupter 1 according to embodiment 3 is configured such that the fixed-side support member 14 and the movable-side support member 15 are provided so as to be fitted to the fixed-side electrode rod 6 and the movable-side electrode rod 7, respectively. While FIG. 9 shows the schematic structure around the movable-side windmill-shaped electrode 13, the schematic structure around the fixed-side windmill-shaped electrode 12 is also the same structure. Therefore, reference characters for parts around the fixed-side windmill-shaped electrode 12 are also shown together in FIG. 9, and description of the schematic structure around the fixed-side windmill-shaped electrode 12 is omitted.

An end surface cutout 7*c* formed along the circumference of the movable-side end surface 7*a* and the movable-side spacer portion 15*a* of the movable-side support member 15 are fitted to each other. The end surface cutout 7*c* is formed through cutting work after the movable-side electrode rod 7 is manufactured, for example.

Figure 10:
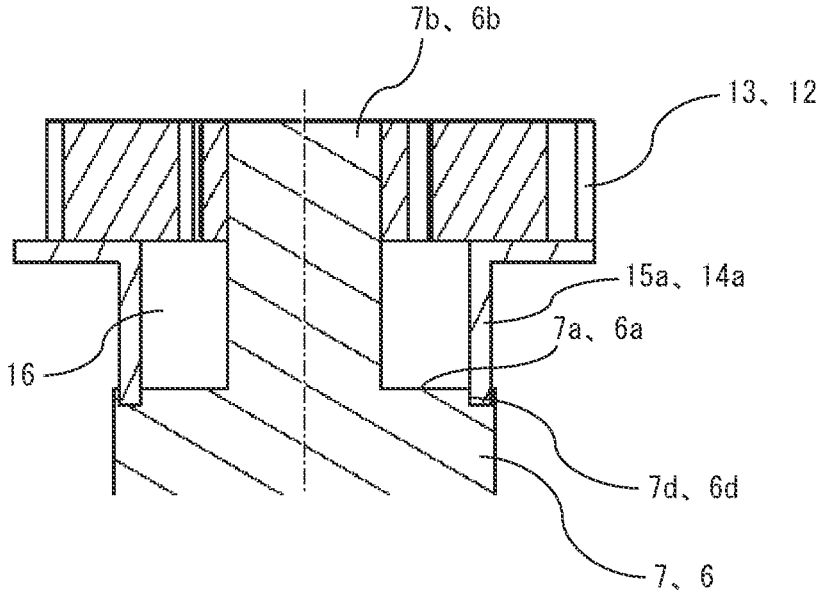
FIG. 10 is a sectional view showing a schematic structure around the windmill-shaped electrode of the vacuum interrupter according to embodiment 3.
Figure 11:
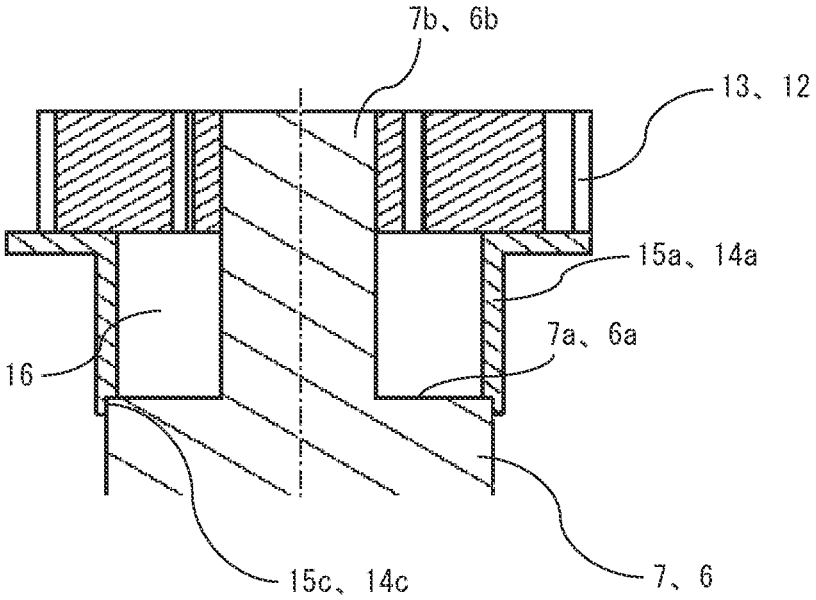
FIG. 11 is a sectional view showing a schematic structure around the windmill-shaped electrode of the vacuum interrupter according to embodiment 3.

The structure for fitting the movable-side support member 15 to the movable-side electrode rod 7 may be a structure shown in a sectional view in FIG. 10. A groove portion 7*d* formed at the movable-side end surface 7*a* and the movable-side spacer portion 15*a* of the movable-side support member 15 are fitted to each other. Alternatively, the structure for fitting the movable-side support member 15 to the movable-side electrode rod 7 may be a structure shown in a sectional view in FIG. 11. An outer circumference of the movable-side end surface 7*a* is fitted to a step portion 15*c* formed by cutting out another end of the movable-side spacer portion 15*a* of the movable-side support member 15 from the inner circumferential side toward the outer circumferential side.

As described above, the vacuum interrupter 1 is configured such that the fixed-side support member 14 and the movable-side support member 15 are fitted to the fixed-side electrode rod 6 and the movable-side electrode rod 7 with use of the end surface cutouts 6*c*, 7*c*, the groove portions 6*d*, 7*d*, or the step portions 14*c*, 15*c*, respectively. Thus, the fixed-side support member 14 and the movable-side support member 15 can be easily positioned, whereby assemblability of the vacuum interrupter 1 can be easily improved. In addition, since the fixed-side support member 14 and the movable-side support member 15 are respectively fixed by being fitted to the fixed-side electrode rod 6 and the movable-side electrode rod 7, position displacement of the movable-side support member 15 and the fixed-side support member 14 can be inhibited. In addition, since the movable-side support member 15 and the fixed-side support member 14 are each fixed by fitting, even if an electromagnetic force is applied to the fixed-side electrode fitting shaft 6*b* and the movable-side electrode fitting shaft 7*b* from the outside when short-circuit current flows, deformation of the fixed-side electrode fitting shaft 6*b* and the movable-side electrode fitting shaft 7*b* which are comparatively thin and have small strengths can be prevented. In the case where the movable-side support member 15 and the fixed-side support member 14 are respectively fixed by being fitted to the groove portions 6*d*, 7*d*, it is possible to design the movable-side support member 15 and the fixed-side support member 14 without depending on the outer diameter sizes of the fixed-side electrode rod 6 and the movable-side electrode rod 7. In the case where the movable-side support member 15 and the fixed-side support member 14 are respectively fixed by being fitted to the step portions 14*c*, 15*c*, parts of the side surfaces of the fixed-side electrode rod 6 and the movable-side electrode rod 7 are covered by the side surfaces of the step portions 14*c*, 15*c*, whereby electric fields around the fixed-side electrode rod 6 and the movable-side electrode rod 7 can be relaxed and voltage withstanding property therearound can be improved.

Embodiment 4

Figure 12:
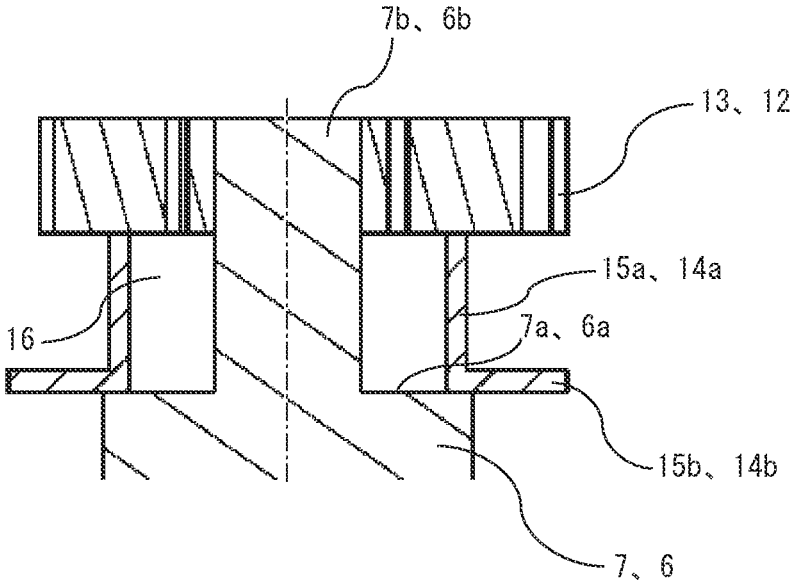
FIG. 12 is a sectional view showing a schematic structure around a windmill-shaped electrode of a vacuum interrupter according to embodiment 4.

A vacuum interrupter 1 according to embodiment 4 will be described. FIG. 12 is a sectional view showing a schematic structure around the movable-side windmill-shaped electrode 13 of the vacuum interrupter 1. The vacuum interrupter 1 according to embodiment 4 is configured such that the fixed-side planar portion 14*b* and the movable-side planar portion 15*b* are in contact with the fixed-side electrode rod 6 and the movable-side electrode rod 7, respectively. While FIG. 12 shows the schematic structure around the movable-side windmill-shaped electrode 13, the schematic structure around the fixed-side windmill-shaped electrode 12 is also the same structure. Therefore, reference characters for parts around the fixed-side windmill-shaped electrode 12 are also shown together in FIG. 12, and description of the schematic structure around the fixed-side windmill-shaped electrode 12 is omitted.

The movable-side planar portion 15*b* is provided at an end of the movable-side spacer portion 15*a* on the side in contact with the movable-side end surface 7*a*. The movable-side support member 15 is made of metal having a high electric resistance, such as stainless steel, and is manufactured through cutting work from a round bar or a pipe material, press work from a pipe material or a plate material, or the like. It is noted that the movable-side support member 15 is not limited to such an integrally formed structure, and may be formed by combining a plurality of parts.

Figure 13:
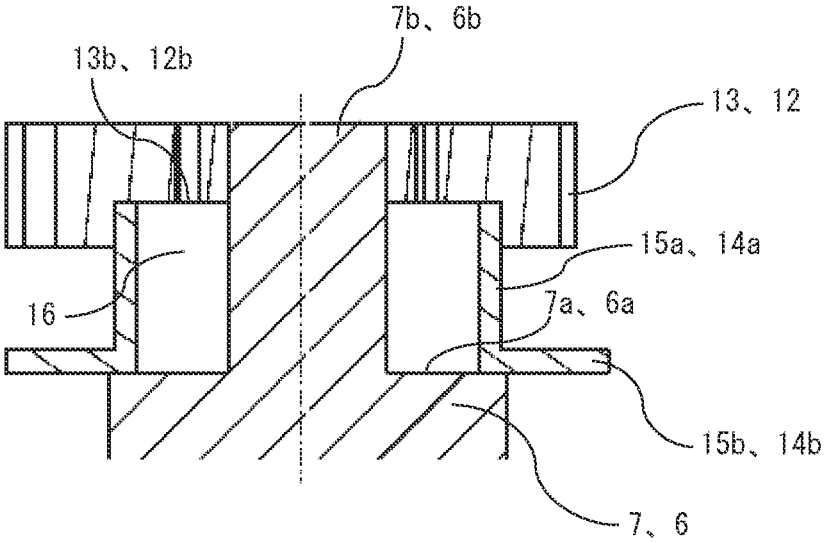
FIG. 13 is a sectional view showing a schematic structure around the windmill-shaped electrode of the vacuum interrupter according to embodiment 4.

Another structure example of the vacuum interrupter 1 having the movable-side support member 15 shown in the present embodiment will be described. FIG. 13 is a sectional view showing a schematic structure around the movable-side windmill-shaped electrode 13 of the vacuum interrupter 1 according to embodiment 4. A groove portion 13*b* formed at an end surface of the movable-side windmill-shaped electrode 13 on the side opposed to the movable-side end surface 7*a*, and the movable-side spacer portion 15*a* of the movable-side support member 15, are fitted to each other. The groove portion 13*b* is formed by cutting work after the movable-side windmill-shaped electrode 13 is manufactured, for example.

As described above, the vacuum interrupter 1 is configured such that the fixed-side planar portion 14*b* and the movable-side planar portion 15*b* are in contact with the fixed-side electrode rod 6 and the movable-side electrode rod 7, respectively. Thus, the contact areas between the fixed-side support member 14 and the fixed-side windmill-shaped electrode 12 and between the movable-side support member 15 and the movable-side windmill-shaped electrode 13, are reduced, whereby leakage current flowing from the fixed-side windmill-shaped electrode 12 and the movable-side windmill-shaped electrode 13 to the fixed-side support member 14 and the movable-side support member 15 can be inhibited. In addition, the contact is made in a state in which the outer circumferences of the fixed-side windmill-shaped electrode 12 and the movable-side windmill-shaped electrode 13 are distant from the fixed-side support member 14 and the movable-side support member 15. Thus, currents flowing at the outer circumferences of the fixed-side windmill-shaped electrode 12 and the movable-side windmill-shaped electrode 13 mainly when arc is driven, can be inhibited from divisionally flowing to the fixed-side support member 14 and the movable-side support member 15. In addition, since the leakage current is inhibited, current supplied to the fixed-side windmill-shaped electrode 12 and the movable-side windmill-shaped electrode 13 is increased. Thus, the magnetic flux density of a magnetic field occurring at the time of electrode opening is increased and the arc drive force is increased, whereby the arc rotation speed increases. As a result, the interruption performance can be improved without size increase in the fixed-side windmill-shaped electrode 12 and the movable-side windmill-shaped electrode 13. In the case where the groove portion 12*b* and the groove portion 13*b* are provided, the fixed-side support member 14 and the movable-side support member 15 can be easily positioned, whereby assemblability of the vacuum interrupter 1 can be easily improved and position displacement of the fixed-side support member 14 and the movable-side support member 15 is inhibited. In addition, in the case where the groove portion 12*b* and the groove portion 13*b* are provided, currents in the parts of the fixed-side windmill-shaped electrode 12 and the movable-side windmill-shaped electrode 13 where the groove portion 12*b* and the groove portion 13*b* are respectively formed flow at positions closer to the electrode surfaces opposed to each other, so that the current densities are increased. Thus, the magnetic flux density of a magnetic field occurring at the time of electrode opening is increased, whereby interruption performance can be further improved.

Embodiment 4 has shown the case of providing the fixed-side planar portion 14*b* and the movable-side planar portion 15*b* at positions different from those in embodiment 1. However, the fixed-side support member 14 or the movable-side support member 15 shown in embodiment 1, and the fixed-side support member 14 or the movable-side support member 15 shown in embodiment 4, may be provided in combination.

Embodiment 5

Figure 14:
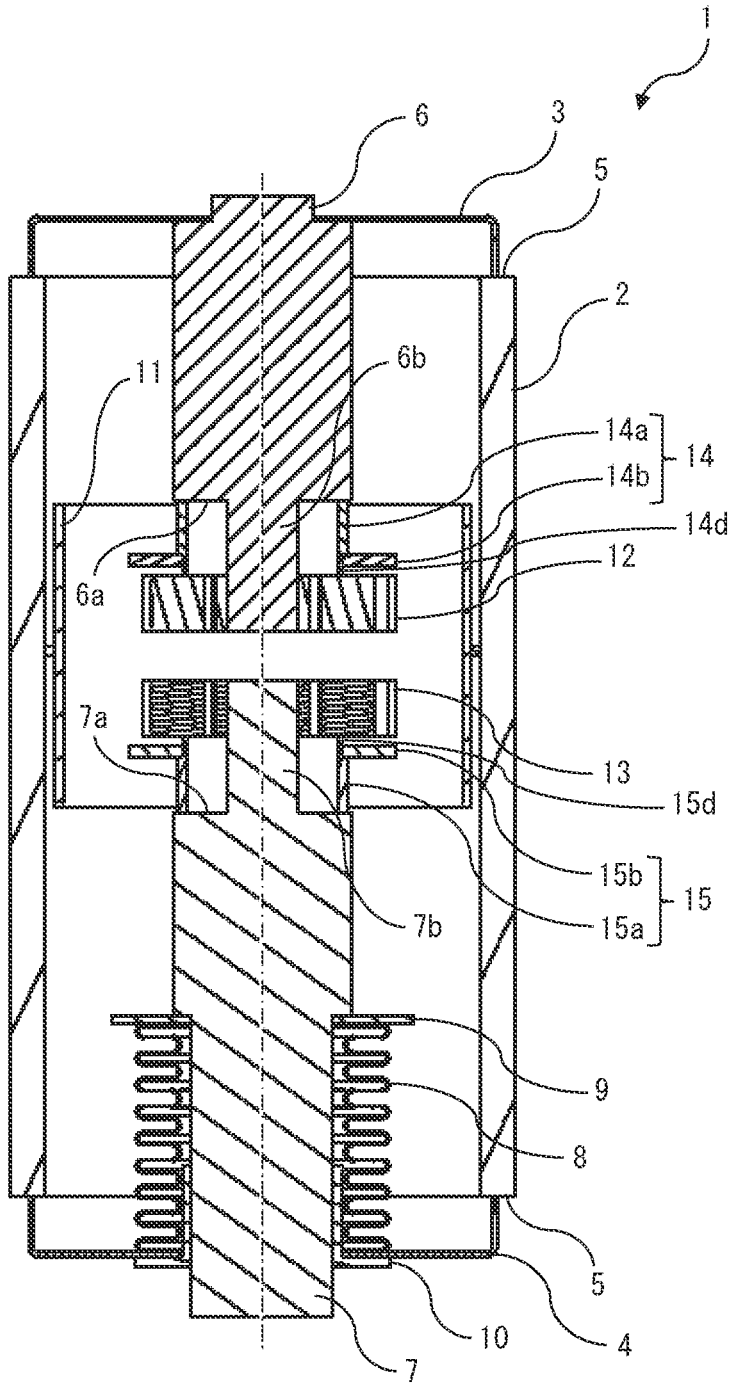
FIG. 14 is a sectional view showing a schematic structure of a vacuum interrupter according to embodiment 5.
Figure 15A:
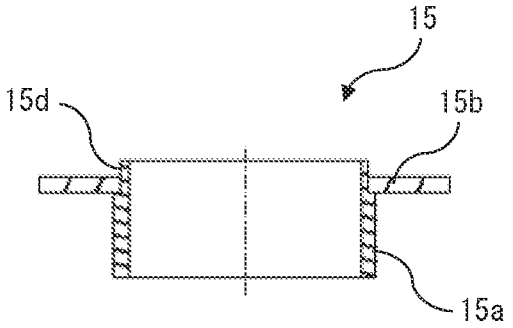
FIG. 15A and FIG. 15B are views showing a schematic structure around a windmill-shaped electrode of the vacuum interrupter according to embodiment 5.
Figure 15B:
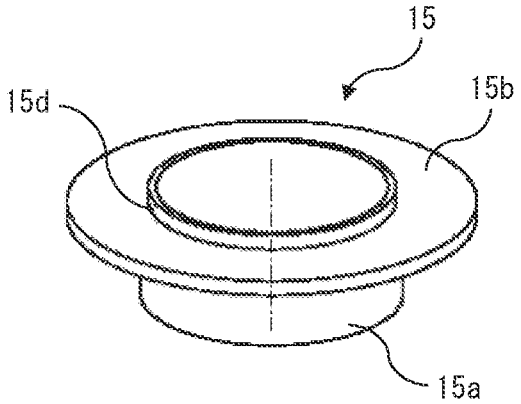

A vacuum interrupter 1 according to embodiment 5 will be described. FIG. 14 is a sectional view showing a schematic structure of the vacuum interrupter 1, and FIG. 15A and FIG. 15B are views showing a schematic structure around the movable-side windmill-shaped electrode 13 of the vacuum interrupter 1. FIG. 15A is a sectional view and FIG. 15B is a perspective view. The fixed-side support member 14 and the movable-side support member 15 of the vacuum interrupter 1 according to embodiment 5 are formed such that the fixed-side planar portion 14*b* and the movable-side planar portion 15*b* are respectively provided between one end and another end of each of the fixed-side spacer portion 14*a* and the movable-side spacer portion 15*a*. While FIG. 15A shows the schematic structure around the movable-side windmill-shaped electrode 13, the schematic structure around the fixed-side windmill-shaped electrode 12 is also the same structure.

The movable-side planar portion 15*b* is provided by being fitted to a fitting portion 15*d* formed by cutting out one end of the movable-side spacer portion 15*a* at the end in contact with the movable-side windmill-shaped electrode 13 from the outer circumferential side toward the inner circumferential side. Similarly, the fixed-side planar portion 14*b* is provided by being fitted to a fitting portion 14*d* formed by cutting out one end of the fixed-side spacer portion 14*a* at the end in contact with the fixed-side windmill-shaped electrode 12 from the outer circumferential side toward the inner circumferential side. The movable-side spacer portion 15*a* is made of metal having a high electric resistance, such as stainless steel, and is manufactured by forming the fitting portion 15*d* through cutting work from a pipe material, for example. The movable-side planar portion 15*b* is made of metal having a high electric resistance, such as stainless steel, and is manufactured through press work from a plate material, for example.

Figure 16A:
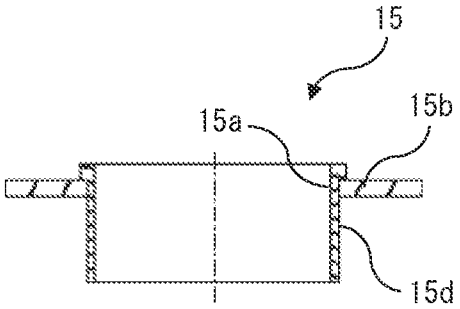
FIG. 16A and FIG. 16B are views showing a schematic structure around the windmill-shaped electrode of the vacuum interrupter according to embodiment 5.
Figure 16B:
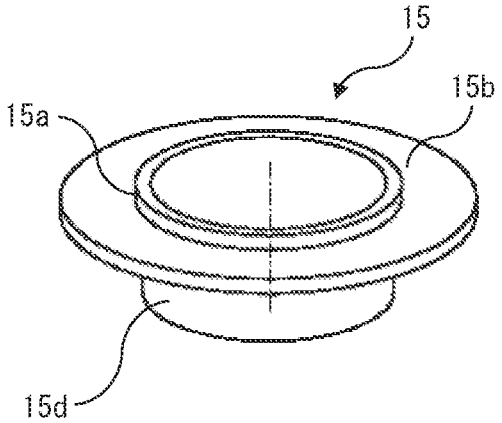

Another structure example of the movable-side support member 15 will be described. FIG. 16A and FIG. 16B are views showing a schematic structure around the movable-side windmill-shaped electrode 13 of the vacuum interrupter 1 according to embodiment 5. FIG. 16A is a sectional view and FIG. 16B is a perspective view. The movable-side planar portion 15*b* is provided by being fitted to the fitting portion 15*d* formed by cutting out another end of the movable-side spacer portion 15*a* at the end in contact with the movable-side end surface 7*a* from the outer circumferential side toward the inner circumferential side. In both of the structures shown in FIG. 15A and FIG. 16A, the position where the movable-side planar portion 15*b* is provided to the movable-side spacer portion 15*a* can be easily changed by changing the length of the fitting portion 15*d* in the movable direction of the movable-side windmill-shaped electrode 13. In a case of reducing the contact area between the movable-side support member 15 and the movable-side windmill-shaped electrode 13, the structure shown in FIG. 15 is desirable. In a case of reducing the contact area between the movable-side support member 15 and the movable-side electrode rod 7, the structure shown in FIG. 16A is desirable.

Figure 17:
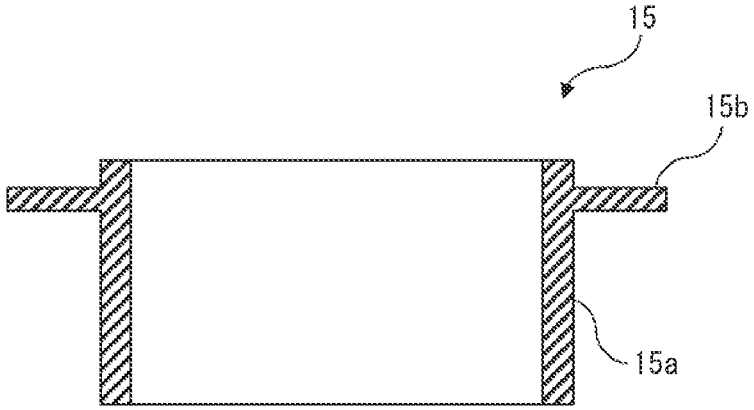
FIG. 17 is a sectional view showing a schematic structure around the windmill-shaped electrode of the vacuum interrupter according to embodiment 5.

In the above description, the case of forming the movable-side support member 15 from the movable-side spacer portion 15*a* and the movable-side planar portion 15*b* which are separate bodies, has been shown. However, as shown in a sectional view in FIG. 17, the movable-side support member 15 may be formed as an integrated body. The movable-side support member 15 is made of metal having a high electric resistance, such as stainless steel, and is manufactured through cutting work from a round bar or a pipe material, for example.

As described above, the fixed-side support member 14 and the movable-side support member 15 of the vacuum interrupter 1 are configured such that the fixed-side planar portion 14*b* and the movable-side planar portion 15*b* are respectively provided between one end and another end of each of the fixed-side spacer portion 14*a* and the movable-side spacer portion 15*a*. Thus, the contact areas between the fixed-side support member 14 and the fixed-side windmill-shaped electrode 12 and between the movable-side support member 15 and the movable-side windmill-shaped electrode 13, and the contact areas between the fixed-side support member 14 and the fixed-side electrode rod 6 and between the movable-side support member 15 and the movable-side electrode rod 7, are both reduced, whereby leakage current flowing to the fixed-side support member 14 and the movable-side support member 15 can be inhibited. In addition, since the leakage current is inhibited, current supplied to the fixed-side windmill-shaped electrode 12 and the movable-side windmill-shaped electrode 13 is increased. Thus, the magnetic flux density of a magnetic field occurring at the time of electrode opening is increased and the arc drive force is increased, whereby the arc rotation speed increases. As a result, the interruption performance can be improved without size increase in the fixed-side windmill-shaped electrode 12 and the movable-side windmill-shaped electrode 13. In addition, in the case of providing the fixed-side planar portion 14*b* and the movable-side planar portion 15*b* by forming the fitting portions 14*d*, 15*d*, it is possible to provide the fixed-side planar portion 14*b* and the movable-side planar portion 15*b* at desired positions. Therefore, the fixed-side planar portion 14*b* and the movable-side planar portion 15*b* can be provided at positions where the function of preventing scattering of metal spatter occurring at the time of current interruption is required.

Although the disclosure is described above in terms of various exemplary embodiments and implementations, it should be understood that the various features, aspects, and functionality described in one or more of the individual embodiments are not limited in their applicability to the particular embodiment with which they are described, but instead can be applied, alone or in various combinations to one or more of the embodiments of the disclosure.

It is therefore understood that numerous modifications which have not been exemplified can be devised without departing from the scope of the present disclosure. For example, at least one of the constituent components may be modified, added, or eliminated. At least one of the constituent components mentioned in at least one of the preferred embodiments may be selected and combined with the constituent components mentioned in another preferred embodiment.

DESCRIPTION OF THE REFERENCE CHARACTERS

1 vacuum interrupter
2 insulation cylinder
3 fixed-side flange
4 movable-side flange
5 metallization layer
6 fixed-side electrode rod
6*a* fixed-side end surface
6*b* fixed-side electrode fitting shaft
6*c* end surface cutout
6*d* groove portion
7 movable-side electrode rod
7*a* movable-side end surface
7*b* movable-side electrode fitting shaft
7*c* end surface cutout
7*d* groove portion
8 bellows
9 bellows cover
10 guide
11 arc shield
12 fixed-side windmill-shaped electrode
12*a* cutout
12*b* groove portion
13 movable-side windmill-shaped electrode
13*a* cutout
13*b* groove portion
13*c* groove
13*d* arc portion
14 fixed-side support member
14*a* fixed-side spacer portion
14*b* fixed-side planar portion
14*c* step portion
14*d* fitting portion
15 movable-side support member
15*a* movable-side spacer portion
15*b* movable-side planar portion
15*c* step portion
15*d* fitting portion
16 space
17 rounded portion
18 tapered portion
100 arc

The invention claimed is:

1. A vacuum interrupter comprising:

an insulation cylinder;

a fixed-side flange sealing one end of the insulation cylinder;

a movable-side flange sealing another end of the insulation cylinder;

a fixed-side electrode rod which is fixed to the fixed-side flange at one end, and has a fixed-side electrode fitting shaft protruding from a fixed-side end surface at another end and having a smaller outer diameter than the fixed-side end surface;

a movable-side electrode rod which is, at one end, connected to the movable-side flange via a bellows on an inner side of the insulation cylinder, and has a movable-side electrode fitting shaft protruding from a movable-side end surface at another end and having a smaller outer diameter than the movable-side end surface, the movable-side electrode rod being slidable in an axial direction of the insulation cylinder;

a fixed-side windmill-shaped electrode fixed to the fixed-side electrode fitting shaft and having a plurality of grooves formed in a swirl shape from a center part toward a peripheral part; and a movable-side windmill-shaped electrode fixed to the movable-side electrode fitting shaft so as to be opposed to the fixed-side windmill-shaped electrode, and having a plurality of grooves formed in a swirl shape from a center part toward a peripheral part, wherein a fixed-side support member is held between the fixed-side end surface and the fixed-side windmill-shaped electrode, the fixed-side support member including a fixed-side spacer portion which has a cylindrical shape and surrounds the fixed-side electrode fitting shaft while being distant from the fixed-side electrode fitting shaft, and a fixed-side planar portion which has a disk shape and which spreads outward from an outer circumferential side surface of the fixed-side spacer portion and is opposed to the fixed-side windmill-shaped electrode, and a movable-side support member is held between the movable-side end surface and the movable-side windmill-shaped electrode, the movable-side support member including a movable-side spacer portion which has a cylindrical shape and surrounds the movable-side electrode fitting shaft while being distant from the movable-side electrode fitting shaft, and a movable-side planar portion which has a disk shape and which spreads outward from an outer circumferential side surface of the movable-side spacer portion and is opposed to the movable-side windmill-shaped electrode.

2. The vacuum interrupter according to claim 1, wherein the fixed-side planar portion is provided at an end of the fixed-side spacer portion on a side in contact with the fixed-side windmill-shaped electrode, or the movable-side planar portion is provided at an end of the movable-side spacer portion on a side in contact with the movable-side windmill-shaped electrode.

3. The vacuum interrupter according to claim 1, wherein the fixed-side planar portion is provided at an end of the fixed-side spacer portion on a side in contact with the fixed-side windmill-shaped electrode, and a cutout is formed around a circumference of an end surface of the fixed-side windmill-shaped electrode on a side in contact with the fixed-side planar portion, or the movable-side planar portion is provided at an end of the movable-side spacer portion on a side in contact with the movable-side windmill-shaped electrode, and a cutout is formed around a circumference of an end surface of the movable-side windmill-shaped electrode on a side in contact with the movable-side planar portion.

4. The vacuum interrupter according to claim 1, wherein the fixed-side planar portion is provided between one end and another end of the fixed-side spacer portion, or the movable-side planar portion is provided between one end and another end of the movable-side spacer portion.

5. The vacuum interrupter according to claim 1, wherein the fixed-side planar portion is provided by being fitted to a fitting portion formed by cutting out one end of the fixed-side spacer portion from an outer circumferential side toward an inner circumferential side, or the movable-side planar portion is provided by being fitted to a fitting portion formed by cutting out one end of the movable-side spacer portion from an outer circumferential side toward an inner circumferential side.

6. The vacuum interrupter according to claim 1, wherein the fixed-side planar portion is provided at an end of the fixed-side spacer portion on a side in contact with the fixed-side end surface, or the movable-side planar portion is provided at an end of the movable-side spacer portion on a side in contact with the movable-side end surface.

7. The vacuum interrupter according to claim 1, wherein a groove portion formed at an end surface of the fixed-side windmill-shaped electrode on a side opposed to the fixed-side end surface, and the fixed-side spacer portion, are fitted to each other, or a groove portion formed at an end surface of the movable-side windmill-shaped electrode on a side opposed to the movable-side end surface, and the movable-side spacer portion, are fitted to each other.

8. The vacuum interrupter according to claim 1, wherein the fixed-side planar portion and the fixed-side spacer portion are connected via a rounded portion or a tapered portion, or the movable-side planar portion and the movable-side spacer portion are connected via a rounded portion or a tapered portion.

9. The vacuum interrupter according to claim 1, wherein a cutout formed along a circumference of the fixed-side end surface, and the fixed-side spacer portion, are fitted to each other, or a cutout formed along a circumference of the movable-side end surface, and the movable-side spacer portion, are fitted to each other.

10. The vacuum interrupter according to claim 1, wherein a groove portion formed at the fixed-side end surface, and the fixed-side spacer portion, are fitted to each other, or a groove portion formed at the movable-side end surface, and the movable-side spacer portion, are fitted to each other.

11. The vacuum interrupter according to claim 1, wherein the fixed-side end surface is fitted to a step portion formed by cutting out another end of the fixed-side spacer portion from an inner circumferential side toward an outer circumferential side, or the movable-side end surface is fitted to a step portion formed by cutting out another end of the movable-side spacer portion from an inner circumferential side toward an outer circumferential side.

12. The vacuum interrupter according to claim 1, wherein the fixed-side support member is made of metal whose electric resistance is higher than an electric resistance of the fixed-side electrode rod, and the movable-side support member is made of metal whose electric resistance is higher than an electric resistance of the movable-side electrode rod.

13. The vacuum interrupter according to claim 1, wherein the fixed-side support member and the fixed-side windmill-shaped electrode are fixed to each other, or the movable-side support member and the movable-side windmill-shaped electrode are fixed to each other.

14. The vacuum interrupter according to claim 1, wherein the fixed-side support member and the fixed-side electrode rod are fixed to each other, or the movable-side support member and the movable-side electrode rod are fixed to each other.

15. The vacuum interrupter according to claim 1, wherein the fixed-side support member and the fixed-side windmill-shaped electrode are fixed to each other, and the fixed-side support member and the fixed-side electrode are fixed to each other, or the movable-side support member and the movable-side windmill-shaped electrode are fixed to each other, and the movable-side support member and the movable-side electrode rod are fixed to each other.

* * * * *